US010667635B1

(12) United States Patent
Howley et al.

(10) Patent No.: US 10,667,635 B1
(45) Date of Patent: Jun. 2, 2020

(54) SUPPORT APPARATUS FOR PLATE AND BEVERAGE CONTAINER

(71) Applicants: Patrick Howley, Chesterfield, MO (US); Robert Kruckemeyer, Spring, TX (US)

(72) Inventors: Patrick Howley, Chesterfield, MO (US); Robert Kruckemeyer, Spring, TX (US)

( * ) Notice: Subject to any disclaimer, the term of this patent is extended or adjusted under 35 U.S.C. 154(b) by 0 days.

(21) Appl. No.: 13/803,676

(22) Filed: Mar. 14, 2013

Related U.S. Application Data

(60) Provisional application No. 61/673,981, filed on Jul. 20, 2012.

(51) Int. Cl.
*A47G 19/02* (2006.01)

(52) U.S. Cl.
CPC ..... *A47G 19/065* (2013.01)

(58) Field of Classification Search
CPC ..... A47G 19/04; A47G 23/0126; A47G 23/0225; B60N 3/103; B65B 67/1205
USPC ..... 220/23.2, 23.4, 575, 9.1, 720, 737; 248/311.2
See application file for complete search history.

(56) References Cited

U.S. PATENT DOCUMENTS 556,200 A 3/1896 McDonald
1,901,837 A 3/1933 Bateholts
D116,623 S 9/1939 Lockwood
2,174,586 A 10/1939 Leppke
2,321,519 A 6/1943 Rubinoff
2,719,414 A 10/1955 Davis
2,803,120 A 8/1957 Wuerfel
2,916,180 A * 12/1959 Alger ..... A47G 19/08 211/41.2
2,920,804 A 1/1960 Minton
D211,532 S 6/1968 Ashton
3,504,832 A 4/1970 Corvetti
3,955,672 A 5/1976 Brundage
3,991,961 A * 11/1976 Platzer, Jr. ..... 248/99
4,461,396 A 7/1984 Harper
4,681,239 A 7/1987 Manns et al.
4,721,216 A 1/1988 Kinder
4,726,553 A 2/1988 Wischusen, III
4,732,274 A 3/1988 Bouton
4,823,958 A 4/1989 Mahmud
4,867,331 A 9/1989 Task
4,938,373 A 7/1990 McKee
4,961,555 A * 10/1990 Egan, Jr. ..... 248/231.81
5,058,737 A 10/1991 Patterson et al.
5,060,820 A 10/1991 Boerner
5,110,170 A * 5/1992 Boatwright ..... 294/146
5,111,960 A 5/1992 Zilliox
5,361,932 A 11/1994 Freidrich
5,419,455 A 5/1995 Russeau
(Continued)

FOREIGN PATENT DOCUMENTS

FR 1000425 A 2/1952

*Primary Examiner* — Andrew T Kirsch
(74) *Attorney, Agent, or Firm* — Greenberg Traurig LLP

(57) ABSTRACT

A support apparatus for a plate and a beverage container is provided. The support apparatus allows a user to handle food, drink and a napkin, preferably in one hand, at a cocktail reception or other venue where the patrons stand and mingle. This allows the user to freely use his or her opposite hand for eating, drinking, greeting or gesturing.

23 Claims, 5 Drawing Sheets

(56) References Cited

U.S. PATENT DOCUMENTS 5,421,459 A 6/1995 Mazzotti
5,607,077 A 3/1997 Torkelson
5,662,240 A 3/1997 Norris
5,639,052 A * 6/1997 Sauve ..... 248/311.2
5,690,036 A * 11/1997 Hasegawa ..... A47B 13/16 108/25
5,695,052 A 12/1997 Damato
5,732,847 A 3/1998 Caldi
5,915,561 A 6/1999 Lorenzana et al.
5,954,195 A 9/1999 Krueger et al.
5,984,131 A 11/1999 Krueger et al.
6,021,914 A 2/2000 Schmidt
6,138,860 A 10/2000 Comeaux
D449,206 S * 10/2001 DuBow ..... D7/708.1
6,338,417 B1 1/2002 Ferraro
6,360,885 B1 3/2002 Krueger et al.
6,425,480 B1 7/2002 Krueger et al.
6,427,864 B1 8/2002 Asselin
6,474,494 B1 11/2002 Miller
6,609,625 B1 8/2003 Gibbar
6,706,297 B1 3/2004 Toth et al.
6,732,894 B2 * 5/2004 Hubbert ..... B29C 45/14754 224/539
6,824,002 B1 11/2004 Hadland
D509,994 S 9/2005 Hadland
7,520,405 B2 * 4/2009 Ishida ..... B60N 3/106 220/737
D600,077 S * 9/2009 Barnes, Jr. ..... D7/620
7,708,248 B2 * 5/2010 Lagobi ..... A47G 23/0225 248/231.21
7,726,512 B2 6/2010 MacCarthy
7,793,905 B2 * 9/2010 Merritt et al. ..... 248/315
8,186,538 B2 5/2012 MacCarthy
8,191,847 B2 * 6/2012 McLaughlin ..... B60N 3/101 220/551
2004/0099670 A1 5/2004 Michaeli
2006/0255050 A1 11/2006 MacCarthy

* cited by examiner

SUPPORT APPARATUS FOR PLATE AND BEVERAGE CONTAINER

CROSS REFERENCE TO RELATED APPLICATIONS

This application claims the benefit and priority benefit of U.S. Provisional Patent Application Ser. No. 61/673,981, filed Jul. 20, 2012, titled "CUP HOLDER WITH PLATE GRIPPING MEANS," the disclosure of which is incorporated herein in its entirety.

BACKGROUND

Field of Invention

This invention relates generally to an apparatus for a user to secure a plate and/or a beverage container during social gatherings.

Description of the Related Art

The following descriptions and examples are not admitted to be prior art by virtue of their inclusion within this section.

Many social gatherings include the service of both food and beverages where attendees mingle while standing. It can be difficult for the attendee to handle his or her plate and drink, as well as napkin and utensil, while at the same time eating and drinking and/or offering a proper greeting to other attendees. For example, with a standard plate and drink combination, both of the attendee's hands are occupied and the attendee is required to perform a delicate manipulation of the plate and drink, as well as napkin and utensil, while attempting to consume the food and drink while standing or while attempting to offer a handshake. Devices for holding a plate and/or beverage container are known, but improvements in this field of invention are desired.

SUMMARY

The following presents a simplified summary of the disclosed subject matter in order to provide a basic understanding of some aspects of the subject matter disclosed herein. This summary is not an exhaustive overview of the technology disclosed herein.

The presently disclosed subject matter generally relates to a support apparatus for a plate and a beverage container. In certain illustrative embodiments, the apparatus allows a user to handle food, drink and a napkin, preferably in one hand, at a cocktail reception or other venue where the patrons stand and mingle. This allows the user to freely use his or her opposite hand for eating, drinking, greeting or gesturing.

In certain illustrative embodiments, a support apparatus for a plate and a beverage container is provided. The support apparatus can include a support frame having an annular collar formed therein. The annular collar can define an aperture and can be sized to contact an outer circumferential wall of the beverage container when the beverage container is disposed within the aperture. The support apparatus can also include a net disposed on the annular collar and extendable therefrom to surround at least a portion of the beverage container when the beverage container is disposed within the aperture. The support apparatus can also include a gripping member disposed on the support frame and extending outwardly therefrom, wherein the gripping member can be slidingly engageable with the plate to secure the plate.

The support apparatus can also include a support disk coupled to the net and engageable with a base of the beverage container when the beverage container is disposed within the aperture. The annular collar can have an inner rim disposed thereon, and the inner rim can contact an outer circumferential wall of the beverage container when the beverage container is disposed within the aperture. The net can have a support disk disposed therewithin, and a base of the beverage container can contact the support disk when the beverage container is disposed within the aperture and sits within the net.

The gripping member can include a central appendage, a first lateral appendage, and a second lateral appendage. The central appendage, first lateral appendage, and second lateral appendage can each be slidingly engageable with the plate to secure the plate. The plate can have a top surface and a bottom surface. The central appendage can contact the top surface of the plate and the first lateral appendage and the second lateral appendage can each contact the bottom surface of the plate when the plate is disposed therebetween. Alternatively, the central appendage can contact the bottom surface of the plate and the first lateral appendage and the second lateral appendage can each contact the top surface of the plate when the plate is disposed therebetween.

The support apparatus can include a gripping pad disposed on the gripping member and grippingly engageable with the plate. The support apparatus can also include a gripping pad disposed on the central appendage and grippingly engageable with the plate. The central appendage, first lateral appendage and second lateral appendage can each have a gripping pad disposed thereon that is grippingly engageable with the plate. The net can be extendable to a distance necessary for the center of gravity of the beverage container to be in the same plane as the center of gravity of the plate when the beverage container is disposed in the aperture and the plate is engaged by the gripping member.

BRIEF DESCRIPTION OF THE DRAWINGS

A better understanding of the presently disclosed subject matter can be obtained when the following detailed description is considered in conjunction with the following drawings, wherein.

While certain preferred illustrative embodiments will be described herein, it will be understood that this description is not intended to limit the subject matter to those embodiments. On the contrary, it is intended to cover all alternatives, modifications, and equivalents, as may be included within the spirit and scope of the subject matter as defined by the appended claims.

DETAILED DESCRIPTION

The presently disclosed subject matter now will be described more fully hereinafter with reference to the accompanying drawings in which embodiments of the apparatus are shown. This apparatus may, however, be embodied in many different forms and should not be construed as limited to the embodiments set forth herein; rather, these embodiments are provided so that this disclosure will be thorough and complete, and will fully convey the scope of the apparatus to those skilled in the art. Like numbers refer to like elements throughout.

Figure 1:
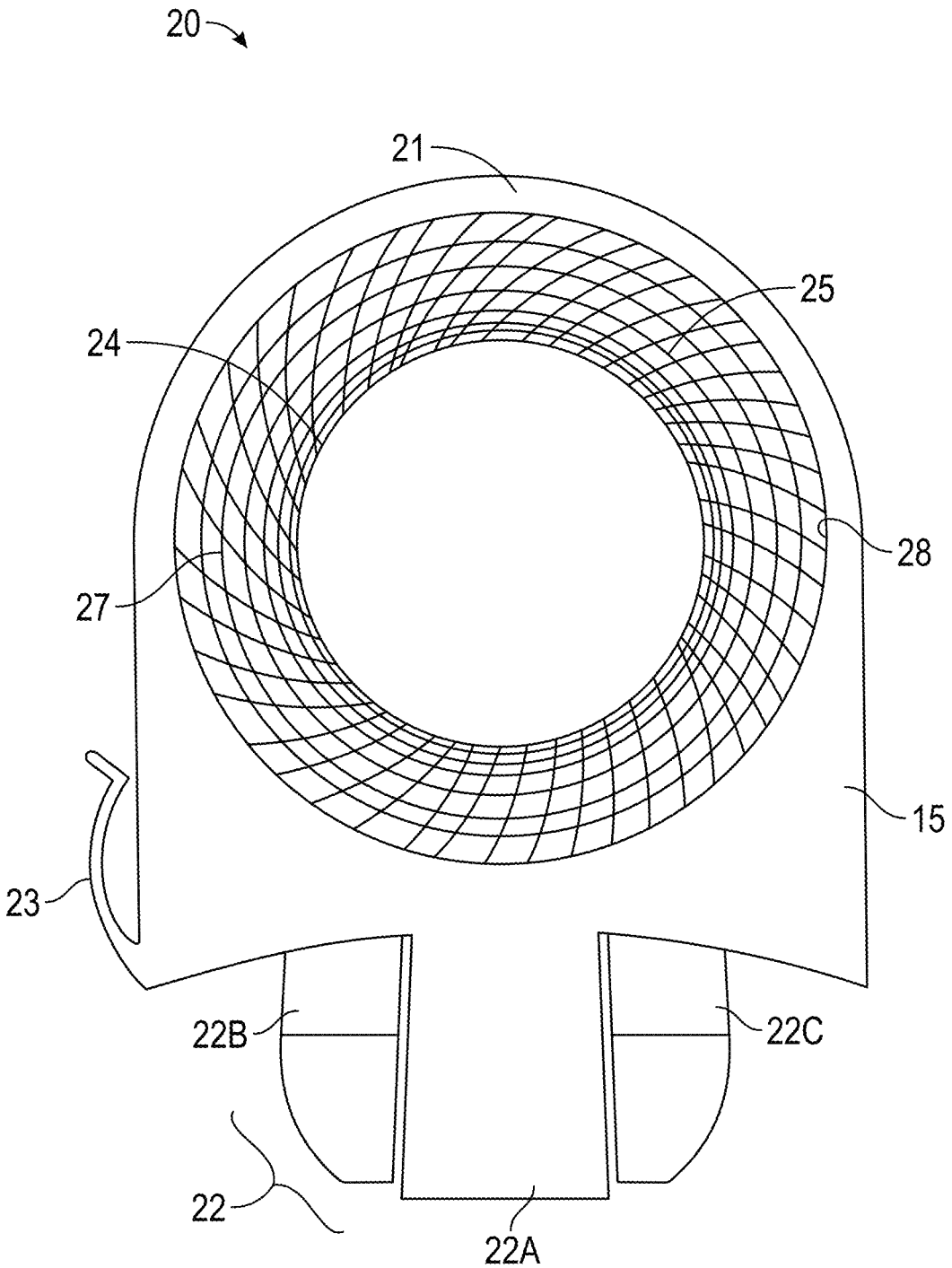
FIG. 1 is a plan view of the top of a support apparatus in accordance with an illustrative embodiment of the presently disclosed subject matter.
Figure 2:
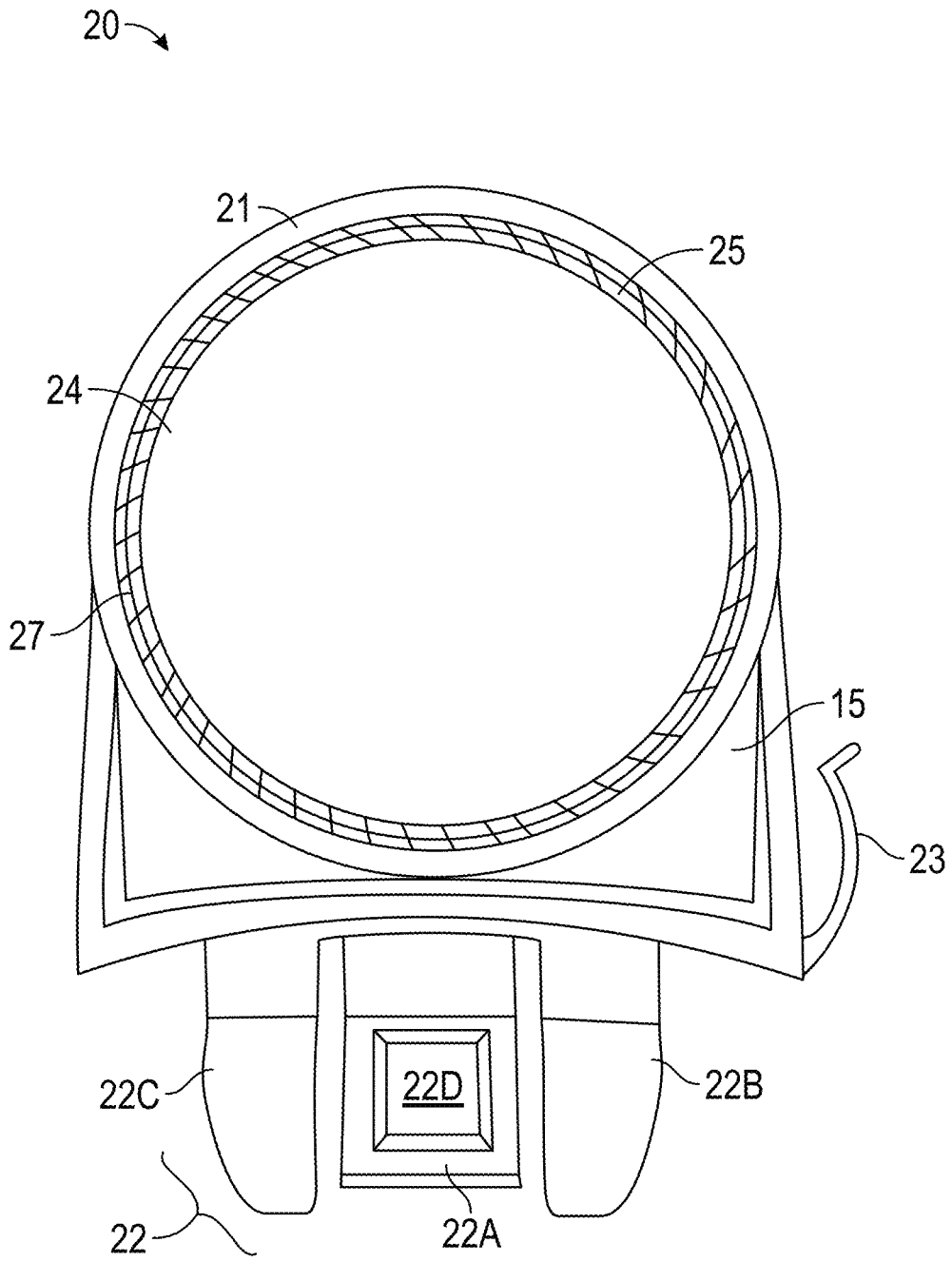
FIG. 2 is a plan view of the bottom of a support apparatus in accordance with an illustrative embodiment of the presently disclosed subject matter.
Figure 3:
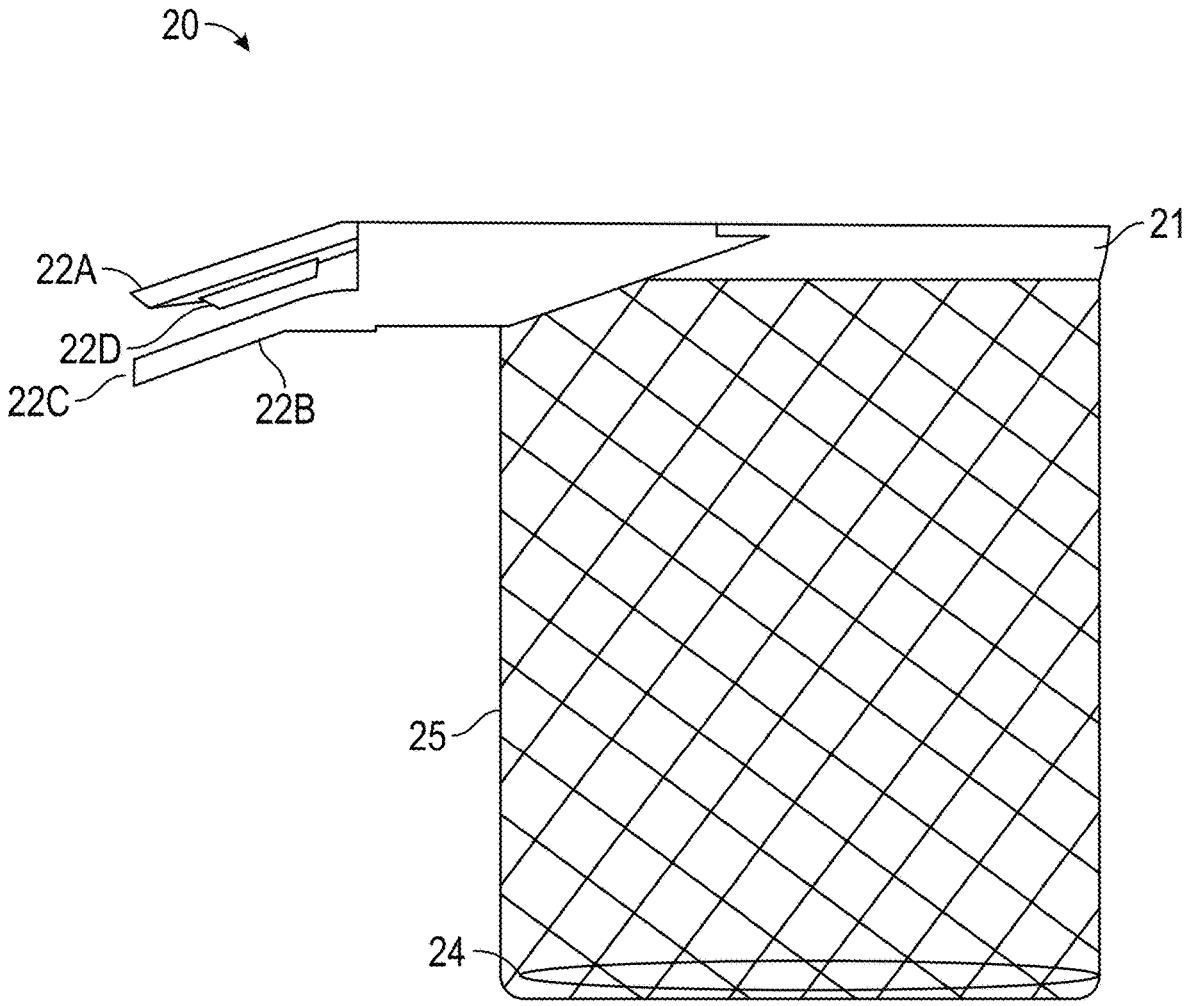
FIG. 3 is a side elevation view of a support apparatus in accordance with an illustrative embodiment of the presently disclosed subject matter.
Figure 4:
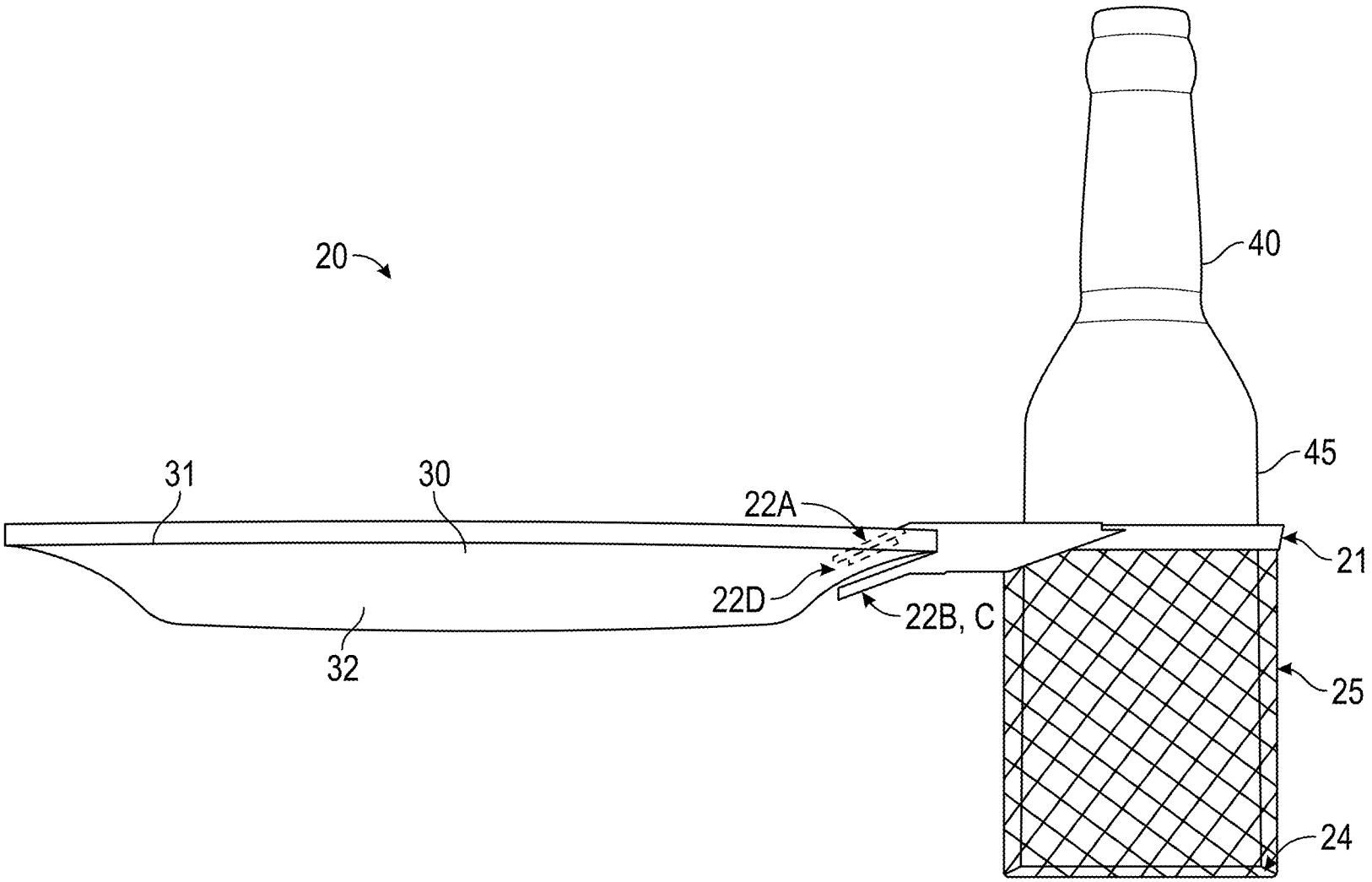
FIG. 4 is a side view of a support apparatus attached to a plate and held aloft in accordance with an illustrative embodiment of the presently disclosed subject matter.

With reference to FIGS. 1-5, various illustrative embodiments of a support apparatus for a plate and a beverage container are provided. FIG. 1 shows a top view of a support apparatus 20 according to certain illustrative embodiments. Apparatus 20 can be used to support a plate 30 and a beverage container 40, such as shown in FIG. 4. Apparatus 20 can comprise a support frame 15 with an annular collar 21 formed therein. Annular collar 21 can define the circumference of an aperture 27 in support frame 15. In certain illustrative embodiments, a napkin holder 23 can also be attached to support frame 15 on a lateral end thereof.

In certain illustrative embodiments, a beverage container 40 (for example, a cup, wine glass, stem wear, soda can, beer bottle or other like container) can be received within annular collar 21 of apparatus 20. Annular collar 21 can have an inner rim 28. In certain illustrative embodiments, inner rim 28 can be made of a soft material to support and/or cushion beverage container 40. Annular collar 21 is preferably sized such that beverage container 40 can rest within aperture 27 when beverage container 40 is disposed within aperture 27. In certain illustrative embodiments, inner rim 28 of annular collar 21 can contact an outer circumferential wall 45 of beverage container 40 when beverage container 40 is disposed within aperture 27.

A net 25 can be disposed on annular collar 21. In certain illustrative embodiments, net 25 can be extendable from annular collar 21. For example, net 25 can have a generally cylindrical shape and hang down from annular collar 21, as illustrated in FIG. 3. Net 25 can surround at least a portion of beverage container 40 when beverage container 40 is disposed within aperture 27, such that beverage container 40 sits within net 25. Net 25 can extend as necessary to allow some or all of beverage container 40 to fit securely therewithin. In certain illustrative embodiments, a support disk 24 can rest at or near the bottom of net 25. The bottom of beverage container 40 can rest on support disk 24 when beverage container 40 sits within net 25. Support disk 24 can have a circular shape, or any other shape that would allow it to fit within net 25 as desired.

A gripping member 22 can be disposed on support frame 15 and extend outwardly therefrom. In certain illustrative embodiments, gripping member 22 can comprise a central appendage 22A, a first lateral appendage 22B, and a second lateral appendage 22C. In a preferred embodiment, first lateral appendage 22B and second lateral appendage 22C can be positioned on opposing sides of central appendage 22A. Gripping member 22 can be used to secure a plate 30 (or dish or other like platewear) to support frame 15. For example, central appendage 22A can slide onto and contact a top surface 31 of plate 30, and first lateral appendage 22B and second lateral appendage 22C can each slide onto and contact a bottom surface 32 of plate 30, thereby causing apparatus 20 to securely fasten to plate 30. Alternatively, central appendage 22A can be positioned with respect to support frame 15 such that appendage 22A slides onto and contacts bottom surface 32 of plate 30, and first lateral appendage 22B and second lateral appendage 22C can be positioned with respect to support frame 15 such that first lateral appendage 22B and second lateral appendage 22C slide onto and contact top surface 31 of plate 30. In the above mentioned illustrative embodiments, central appendage 22A, first lateral appendage 22B and second lateral appendage 22C collectively secure plate 30 to support frame 15 so that plate 30 does not fall when apparatus 20 is held by a user.

FIG. 2 shows a bottom view of apparatus 20 of FIG. 1, according to certain illustrative embodiments. As seen in FIG. 2, a gripping pad 22D can be secured to central appendage 22A. In certain illustrative embodiments, gripping pad 22D can be secured to one or more of central appendage 22A, first lateral appendage 22B and second lateral appendage 22C to assist in securely attaching gripping member 22 to plate 30. Gripping pad 22D can have a rubber or similar tacky surface to enhance gripping properties.

FIG. 3 shows apparatus 20 in a side plan view, according to certain illustrative embodiments. FIG. 4 shows apparatus 20 in a side plan view and secured to plate 30 as they would be positioned if plate 30 was held aloft by a user's hand, according to certain illustrative embodiments.

Figure 5:
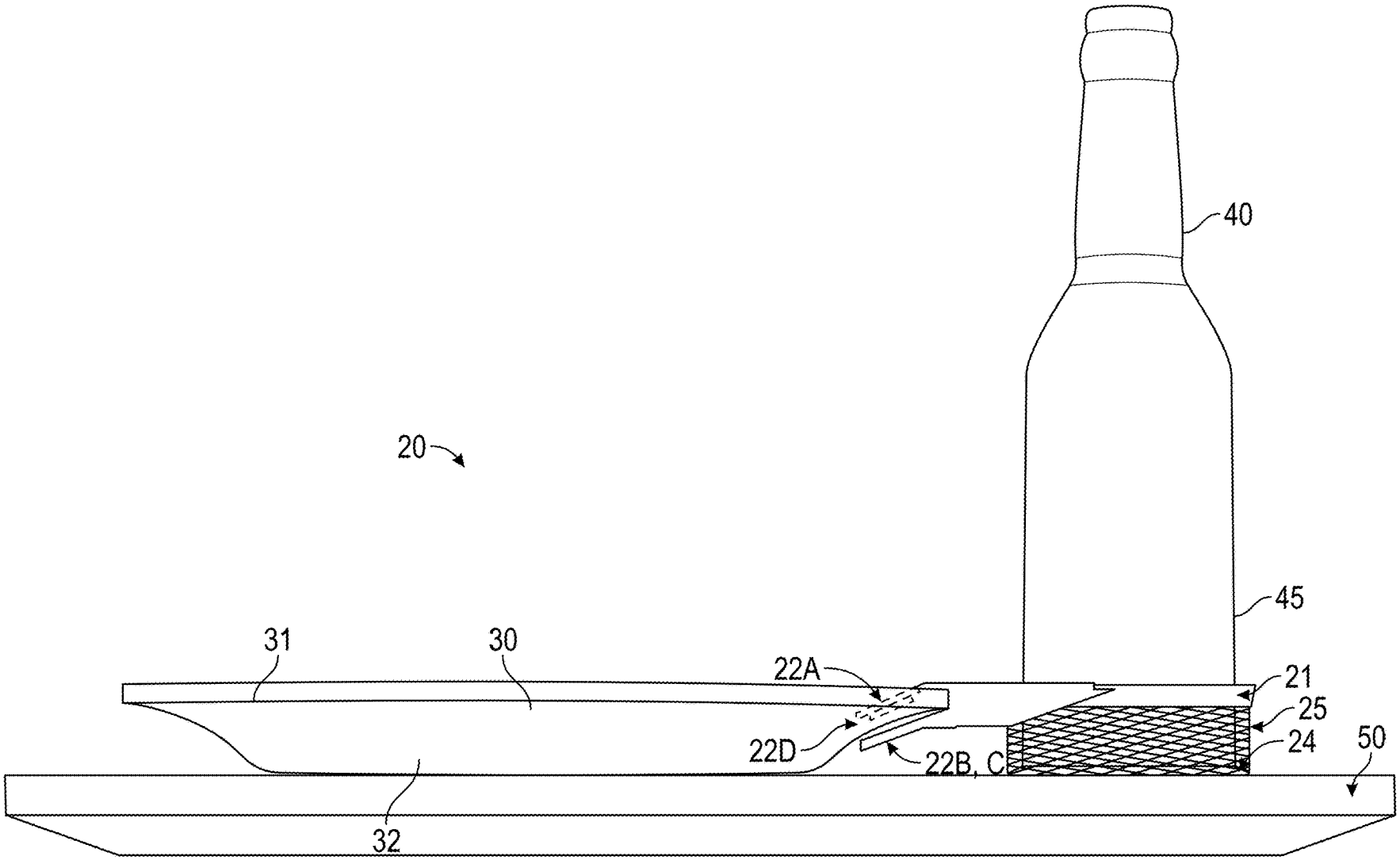
FIG. 5 is a side view of a support apparatus attached to a plate as it is resting on a table in accordance with an illustrative embodiment of the presently disclosed subject matter.

FIG. 5 shows apparatus 20 in a side plan view secured to plate 30 while plate 30 is resting on a table or other flat surface, according to certain illustrative embodiments. Beverage container 40 is disposed within annular collar 21 and is held securely in place by net 25. Support disk 24 is disposed within net 25 and contacts the base of beverage container 40. Beverage container 40 can rest on support disk 24 as support disk 24 sits on the tabletop surface.

In certain illustrative embodiments, net 25 can extend to a distance necessary for the center of gravity of beverage container 40 to be in the same plane as plate 30, while beverage container 40 is securely held inside annular collar 21 for stability purposes. For example, as shown in FIG. 4, when a user is holding plate 30 secured to apparatus 20 with beverage container 30 disposed therein, the bottom of beverage container 30 may hang lower than the bottom of plate 30, and net 25 will extend to secure beverage container 40 therewithin. Alternatively, when plate 30 is set on a table or other flat surface, as shown in FIG. 5, net 25 will collapse such that the bottom of plate 30 and the bottom of beverage container 40 are on the same plane and both plate 30 and apparatus 10 can rest on the table or other flat surface in a stable manner.

In the illustrative embodiments shown herein, apparatus 20 allows a user to handle and hold aloft both food on plate 30 and a beverage in beverage container 40 with one hand. Apparatus 20 can also be set down on a flat surface in a stable manner without the need to handle or otherwise adjust beverage container 40 with respect to support disk 24 or inside annular collar 21. Apparatus 20 can be used with all manner of beverage containers such as cans, bottles, drinking glasses and stemware. Further, apparatus 20 can be manufactured in a wide variety of materials. For example, support frame 15 can be made of materials such as plastic, rubber and fiberglass, and net 25 can be made of materials such as nylon and plastic.

In general, apparatus 20 can be used with plates of any circumference or diameter, although preferably plate 30 will have an angular rim. Thus, apparatus 20 does not require the purchase of specially designed plates for use therewith. Apparatus 20 can be easily attached and detached to various shapes of plates and allows the plates to be washed in their usual manner. Apparatus 20 can also be easily washed.

Once apparatus 20 is attached to plate 30, plate 30 can be rotated for ease of use by either left or right handed individuals. Apparatus 20 can be used with plates as typically used by eating establishments and catering companies and is easily attached and detached from such plates for ease of washing and handling.

It is to be understood that the described subject matter is not limited to the exact details of construction, operation, exact materials, or illustrative embodiments shown and described, as modifications and equivalents will be apparent to one skilled in the art. Accordingly, the subject matter is therefore to be limited only by the scope of the appended claims.

What is claimed is:

1. A support apparatus for a plate and a beverage container, the support apparatus comprising:

a support frame having an annular collar formed therein, the annular collar defining an aperture, the annular collar sized to contact and completely encircle an outer circumferential wall of the beverage container when the beverage container is disposed within the aperture;

an inner rim formed on the annular collar, the inner rim having a uniform radius about its entire circumference;

a net disposed on the annular collar and extendable therefrom to surround at least a portion of the beverage container when the beverage container is disposed within the aperture; and a gripping member disposed on the support frame and extending at least radially outwardly from an edge of the support frame, the gripping member extending outwardly in a substantially non-curved orientation along its entire longitudinal extent, the gripping member being slidingly engageable with the plate to secure the plate, wherein the gripping member comprises a central appendage, a first lateral appendage, and a second lateral appendage, the central appendage, first lateral appendage, and second lateral appendage each being slidingly engageable with the plate to secure the plate.

2. The support apparatus of claim 1, further comprising a support disk coupled to the net and engageable with a base of the beverage container when the beverage container is disposed within the aperture.

3. The support apparatus of claim 1, wherein the annular collar has an inner rim disposed thereon, and the inner rim contacts an outer circumferential wall of the beverage container when the beverage container is disposed within the aperture.

4. The support apparatus of claim 1, wherein the net has a support disk disposed therewithin, and a base of the beverage container contacts the support disk when the beverage container is disposed within the aperture and sits within the net.

5. The support apparatus of claim 1, wherein the plate has a top surface and a bottom surface, and wherein the central appendage contacts the top surface of the plate and the first lateral appendage and the second lateral appendage each contact the bottom surface of the plate when the plate is disposed therebetween.

6. The support apparatus of claim 1, wherein the plate has a top surface and a bottom surface, and wherein the central appendage contacts the bottom surface of the plate and the first lateral appendage and the second lateral appendage each contact the top surface of the plate when the plate is disposed therebetween.

7. The support apparatus of claim 1, further comprising a gripping pad disposed on the gripping member and grippingly engageable with the plate.

8. The support apparatus of claim 1, further comprising a gripping pad disposed on the central appendage and grippingly engageable with the plate.

9. The support apparatus of claim 1, wherein the central appendage, first lateral appendage and second lateral appendage each have a gripping pad disposed thereon that is grippingly engageable with the plate.

10. The support apparatus of claim 1, wherein the net is extendable to a distance necessary for the center of gravity of the beverage container to be in the same plane as the center of gravity of the plate when the beverage container is disposed in the aperture and the plate is engaged by the gripping member.

11. The support apparatus of claim 1, further comprising a napkin holder attached to the support frame.

12. The support apparatus of claim 1, wherein the flat surface is a table top.

13. The support apparatus of claim 1, wherein the annular collar is sized to contact and completely encircle an outer circumferential wall of the beverage container when the beverage container is disposed within the aperture.

14. The support apparatus of claim 1, wherein each of the central appendage, the first lateral appendage and the second lateral appendage extend outwardly from an edge of the support frame and wherein the longitudinal axis of each of the central appendage, the first lateral appendage and the second lateral appendage has a non-curved shape.

15. The support apparatus of claim 1, wherein the central appendage, the first lateral appendage and the second lateral appendage each extend at least radially outwardly from an edge of the support frame in a substantially non-curved orientation along their entire longitudinal extent.

16. The support apparatus of claim 1, wherein the central appendage, the first lateral appendage and the second lateral appendage each extend outwardly from the support frame at an angle that is not parallel with the plane of the support frame.

17. The support apparatus of claim 1, wherein the central appendage has a pair of side edges that are each straight along their entire longitudinal extent.

18. The support apparatus of claim 1, wherein the first lateral appendage and the second lateral appendage each have at least one side edge that is straight along its entire longitudinal extent.

19. The support apparatus of claim 1, wherein the annular collar is wholly and uninterruptedly annular about its entire circumference.

20. A support apparatus for a plate and a beverage container, the support apparatus comprising:

a support frame having an annular collar formed therein, the annular collar defining an aperture, the annular collar sized to contact and completely encircle an outer circumferential wall of the beverage container when the beverage container is disposed within the aperture;

an inner rim formed on the annular collar, the inner rim having a uniform radius about its entire circumference;

a net disposed on the annular collar and extendable therefrom to surround at least a portion of the beverage container when the beverage container is disposed within the aperture; and a gripping member disposed on the support frame and comprising a central appendage, a first lateral appendage and a second lateral appendage each extending at a downward oblique angle from an edge of the support frame when the support frame is disposed in an upright orientation, the gripping member being slidingly engageable with the plate to secure the plate.

21. The support apparatus of claim 20, wherein none of the central appendage, the first lateral appendage or the second lateral appendage have a longitudinal extent that extends past the widest portion of the support frame when the support frame is disposed in an upright orientation.

22. The support apparatus of claim 20, wherein the annular collar is wholly and uninterruptedly annular about its entire circumference.

23. A support apparatus for a plate and a beverage container, the support apparatus comprising: a support frame having an annular collar formed therein, the annular collar defining an aperture, the annular collar sized to contact and completely encircle an outer circumferential wall of the beverage container when the beverage container is disposed within the aperture, the annular collar having an inner rim disposed thereon, wherein the inner rim contacts an outer circumferential wall of the beverage container when the beverage container is disposed within the aperture; an inner rim formed on the annular collar, the inner rim having a uniform radius about its entire circumference, wherein the inner rim is formed of a soft material capable of supporting the container; a cylindrically shaped net disposed on the annular collar and collapsible therefrom to surround at least a portion of the beverage container when the beverage container is disposed within the aperture, wherein the net has a support disk disposed therewithin, and a base of the beverage container contacts the support disk when the beverage container is disposed within the aperture and sits within the net, the net being retractable from its fully collapsed position such that the support plate is in the same plane with the annular collar, and wherein the support disk is coupled to the net and engageable with a base of the beverage container when the beverage container is disposed within the aperture; a gripping member disposed on the support frame and extending at least radially outwardly from an edge of the support frame, the gripping member being slidingly engageable with the plate to secure the plate, the gripping member comprising a central appendage, a first lateral appendage, and a second lateral appendage, the central appendage, first lateral appendage, and second lateral appendage each being tilted at a downward angle with respect to the annular collar and each being slidingly engageable with the plate to secure the plate; and a gripping pad disposed on the gripping member and grippingly engageable with the plate.

* * * * *